US007735153B1

(12) United States Patent
Romiti

(10) Patent No.: US 7,735,153 B1
(45) Date of Patent: Jun. 15, 2010

(54) TEXTILE FABRICATOR'S GLOVE

(76) Inventor: Gail Marie Romiti, 220 N. Cottage Rd., Sterling, VA (US) 20164

( * ) Notice: Subject to any disclaimer, the term of this patent is extended or adjusted under 35 U.S.C. 154(b) by 291 days.

(21) Appl. No.: 10/359,126

(22) Filed: Feb. 6, 2003

(51) Int. Cl.
*A41D 19/00* (2006.01)

(52) U.S. Cl. ..... 2/163; 2/161.6

(58) Field of Classification Search ..... 2/16, 2/20, 161.1–161.5, 163, 160, 161.6; 15/227
See application file for complete search history.

(56) References Cited

U.S. PATENT DOCUMENTS 436,206 A * 9/1890 Bertheau et al. ..... 30/123.5
3,787,898 A * 1/1974 Walker ..... 2/163
4,038,787 A * 8/1977 Bianchi ..... 451/523
4,507,807 A * 4/1985 Karkanen ..... 2/161.8
4,751,747 A * 6/1988 Banks et al. ..... 2/21
4,864,661 A 9/1989 Gimbel
5,442,816 A 8/1995 Seketa
5,598,582 A * 2/1997 Andrews et al. ..... 2/16
5,661,853 A * 9/1997 Wilmot ..... 2/163
6,098,854 A 8/2000 Apple
6,189,150 B1 * 2/2001 Jones-Roberson ..... 2/163
6,279,165 B1 * 8/2001 Kobayashi ..... 2/163
6,409,059 B1 * 6/2002 Calvert ..... 223/101

* cited by examiner

*Primary Examiner*—Katherine Moran

(57) ABSTRACT

A glove with grip areas which facilitates the manipulation of sewing implements and fabrics.

3 Claims, 2 Drawing Sheets

TEXTILE FABRICATOR'S GLOVE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates to gloves, and more particularly to gloves useful for people engaged in fabricating finished textile products.

Fabrication of finished textile products such as drapery and clothing generally involves a human fabricator performing several discrete operations on fabrics. These operations include measuring, cutting, pinning, stitching etc. Some of these operations are done entirely by hand, and some with the aid of machines. Each operation requires manipulation of sewing implements such as needles, pins and scissors and/or materials such as fabrics and thread. Repetitive pushing, pulling and guiding of the implements and materials can result in callouses, rashes, cuts, blisters, bruises and damage to fingernails. In addition, the effort required to maintain friction on the article being manipulated produces muscle fatigue. This effect is exacerbated when fibers from the fabric adhere to the skin, further reducing friction. A thimble placed over the end of a finger is commonly used to aid the pushing of needles and pins through fabric. However, thimbles significantly reduce tactile sensitivity and interfere with the act of pulling on a pin, needle or fabric because they provide less friction than the bare hand. Hence, thimbles are often removed and replaced during hand stitching. The frequent removal and replacement of the thimble is inconvenient and reduces the productivity of the fabricator. Additionally, thimbles have an unfortunate tendency to fall off the user's finger.

The prior art contains devices with means for protecting the hand from injuries such as unintentional punctures, but these devices do not facilitate the manipulation of sewing utensils and fabrics by providing friction, tactile sensitivity, and reinforcement for those areas of the hand where it is most beneficial to one engaged in fabricating finished textile products. The prior art means do not exhibit the combination of properties and positioning to best facilitate the manipulation of sewing utensils and fabrics.

SUMMARY OF THE INVENTION

It is therefore an object of the invention to provide a device which may be worn continuously during all fabrication operations, and which facilitates the manipulation of sewing implements and fabrics while protecting the hand of the user. Another object of the current invention is to provide a device which maintains a high degree of comfort and tactile sensitivity.

These and other objectives are achieved by providing a glove having a plurality of finger stalls, each stall containing at least one grip area positioned to maximally aid a textile fabricator in manipulating sewing implements and materials.

Preferably, some fingers are left uncovered to allow bare-skinned contact between the work and those fingers. Additionally, the palmar portion of the glove may contain a grip area. The glove may also support a magnet useful for holding sewing implements such as pins and needles.

Additional objects, features and attendant advantages will become apparent to one skilled in the art from a reading of the following disclosure of preferred embodiments constructed in accordance with the invention, taken in conjunction with the accompanying drawings in which:

DESCRIPTION OF PREFERRED EMBODIMENTS

Figure 1:
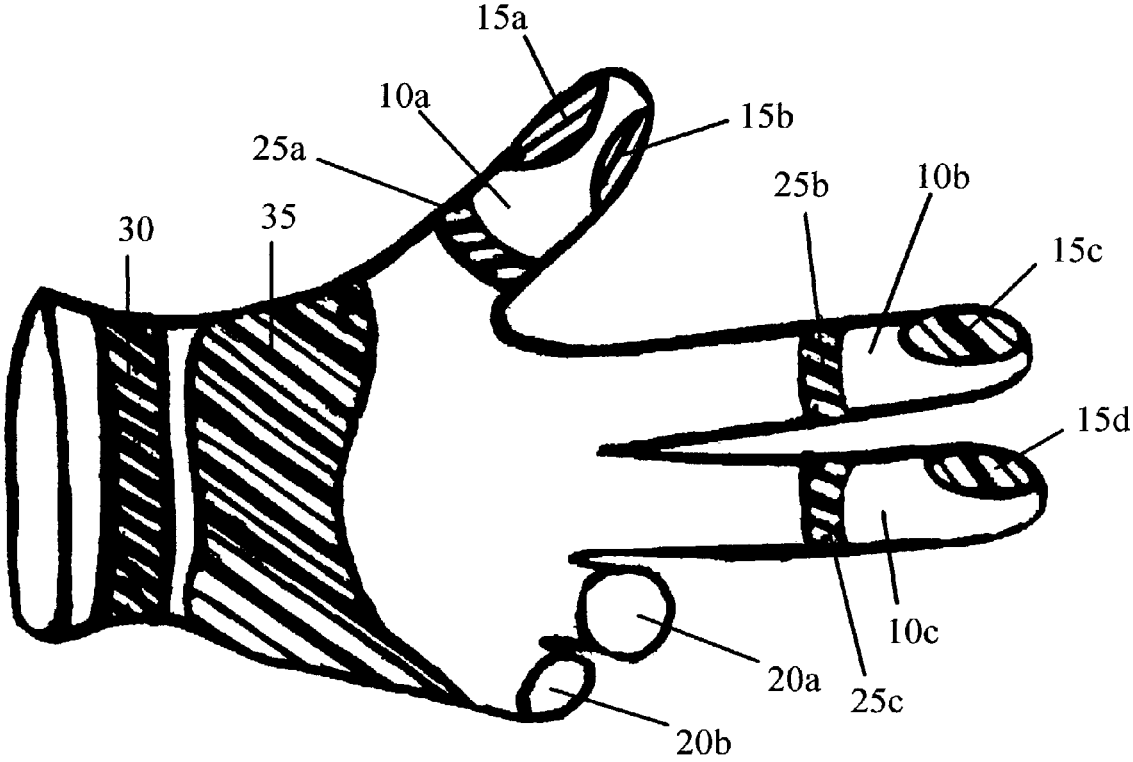
FIG. 1 is a top view of the glove for the left hand, palm side up.

As shown in the drawings, a glove for the left hand includes three finger stalls 10*a*, 10*b* and 10*c* for the thumb, index finger, and middle finger respectively. Normally the glove will be worn as one of a pair, with a mirror image glove worn on the right hand. Openings 20*a* and 20*b* allow the ring finger and little finger to protrude through the glove. Although not shown in the drawings, it is within the scope of the invention to construct the glove with only two finger stalls 10*a* and 10*b*, for the thumb and index finger respectively, with all other features unchanged. The middle finger would then protrude through an opening analogous to opening 20*a* or 20*b*. The absence of the stall for the middle finger allows bare-skinned contact between the middle finger and the work and is particularly effective for hand stitching. The glove is preferably well-ventilated and made of a woven natural fiber such as cotton, although synthetic fibers, natural/synthetic blends and non-woven materials such as latex rubber may also be used. A knitted seamless glove is especially preferred, since seams may interfere with tactile sensitivity. An elastic fiber may be incorporated into the weave to provide a snug fit. Elastane (Spandex) is an especially preferred material for the elastic fiber. If non-porous material such as latex rubber is used for the glove, it is desirable to provide ventilation holes to allow for evaporation of perspiration.

The finger stalls 10*a*, 10*b* and 10*c* contain grip areas 15*a*–15*d* which are shown as substantially elliptical in the figures, but other shapes are possible. The grip areas 15*a*–15*d* serve several important functions: helping the wearer grip and manipulate fabrics and sewing implements; preventing skin irritation such as bruising, callousing, and blistering; preventing damage to fingernails; and reinforcing those portions of the glove which receive the most wear. In addition, the friction provided by the grip areas 15*a*–15*d* allows the wearer to grip sewing implements and fabrics with less muscular effort, thereby reducing fatigue. This friction is especially useful when maintaining tension on a fabric during pinning, measuring or machine stitching. Simply putting on the glove positions the grip areas where they can be most effective.

The grip areas 15*a*–15*d* are located where they can best facilitate manipulation of pins, needles, fabric, thread and the like. As shown in the drawings, the stall for the thumb 10*a* contains two grip areas, 15*a* and 15*b*, each located over a portion of the distal segment of the thumb. Grip area 15*a* overlies a portion of one side of the distal segment of the thumb and grip area 15*b* overlies a portion of the other side of the distal segment of the thumb. Additionally, a portion of each grip area overlies part of the thumb pad. The part of the thumb pad between grip area 15*a* and 15*b* remains uncovered by a grip area to maintain as much tactile sensitivity as possible.

Figure 3:
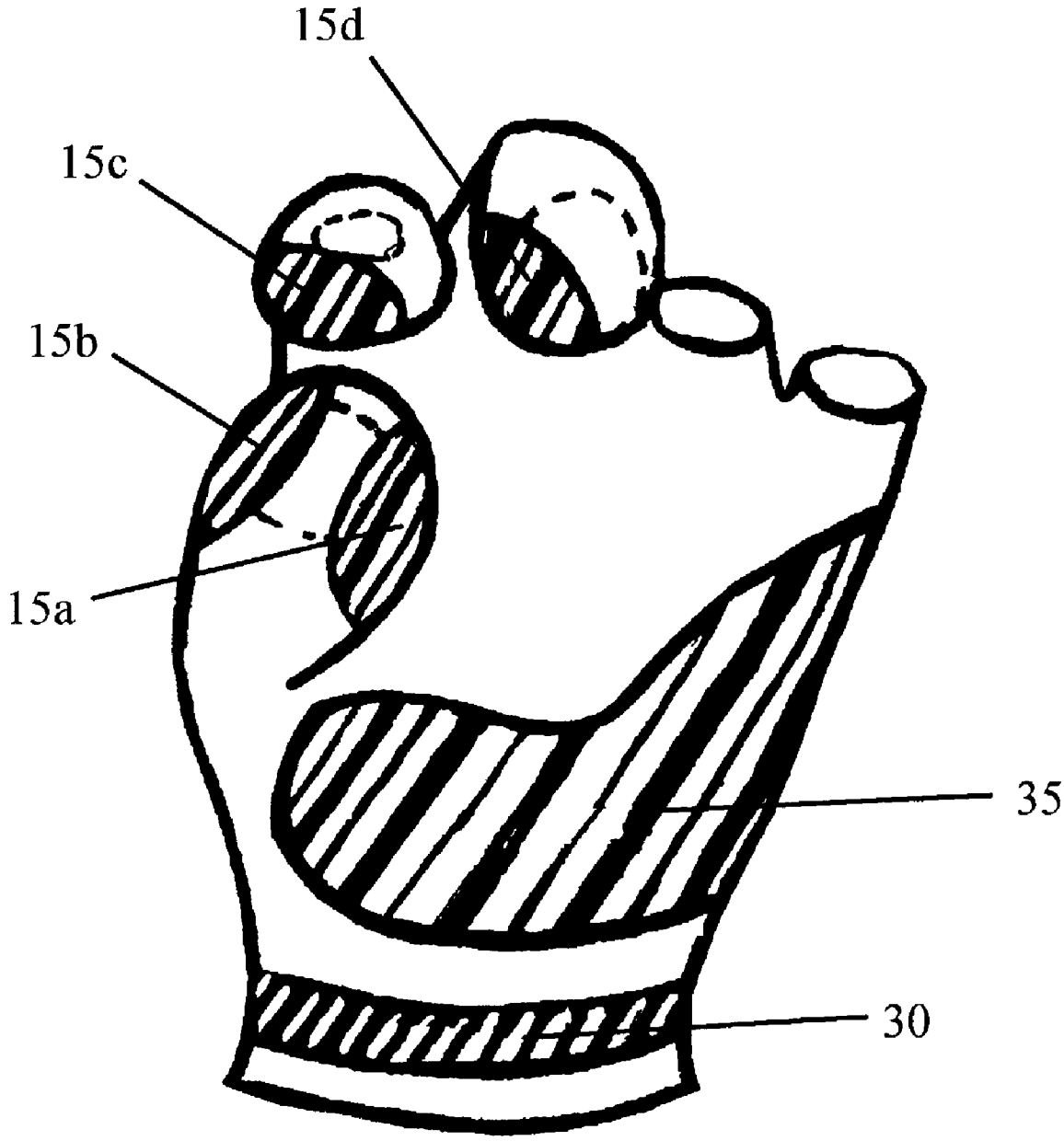
FIG. 3 is a top view of the glove for the left hand, in a grasping pose, palm side up.

The stall for the index finger 10*b* contains grip area 15*c* and the stall for the middle finger 10*c* contains grip area 15*d*. Grip area 15*c* overlies a portion of the side of the distal segment of the index finger adjacent the thumb. In similar fashion to the grip areas 15*a* and 15*b*, the grip area 15*c* also overlies part of the pad of the index finger. This positioning allows an object held between the thumb and index finger to be sandwiched between grip areas 15*b* and 15*c*, as shown most clearly in FIG. 3. Grip area 15*d* is analogous to grip area 15*c* and overlies a portion of the side of the distal segment of the middle finger adjacent the index finger, as well as a portion of the pad of the middle finger.

The grip areas 15*a*–15*d* are preferably non-rigid, and may be made from a variety of materials or combinations of materials, as long as the material or combination of materials exhibits the following properties: sufficient durability to withstand repeated use, enough tactile sensation to allow the user to properly feel and manipulate the sewing implement, sufficient cushioning to reduce the callousing or other discomfort experienced by bare-handed textile fabricators and sufficient friction to enable the wearer to easily grip the material or sewing implement without significant slippage. Preferably, the grip areas 15*a*–15*d* have a coefficient of friction greater than the coefficient of friction of a human finger pad, and it is most preferred that the coefficient of friction be about twice that of a human finger pad. Gripping sewing implements using grip areas having twice the coefficient of friction of a human finger pad would require half as much muscular effort as gripping the same sewing implements with bare skin. The grip areas 15*a*–15*d* may be made vapor transmissive to allow for evaporation of perspiration. Vapor transmissivity can be achieved by selecting naturally transmissive materials or by providing small pores in the grip areas 15*a*–15*d*. Examples of suitable materials include but are not limited to, natural or synthetic rubber and thermosetting or thermoplastic polymers with or without reinforcing materials such as glass fibers, graphite fibers or mineral particles. Vinyl resins are particularly effective materials.

The grip areas 15*a*–15*d* may be incorporated into the glove using any known technology, for example by applying a molten thermoplastic or thermosetting material. An alternative method of applying the grip areas 15*a*–15*d* utilizes preshaped rubber or plastic appliques backed by a peel-and-stick adhesive. The appliques can be packaged with the glove for application by the end-user to reduce manufacturing costs.

Each finger stall 10*a*, 10*b* and 10*c* may also contain a finger stall retaining means 25*a*, 25*b* and 25*c* respectively. The retaining means 25*a*, 25*b* and 25*c* are rings of elastomeric material which encircle the finger and maintain the stall in place on the finger. The retaining means 25*a*–25*c* may be made of any elastomeric material such as rubber or plastic and can be applied to the exterior of each finger stall 10*a*, 10*b* and 10*c*. Alternatively, the retaining means may be incorporated into the weave using elastic fibers or an elastic band. Preferably the retaining means is located below the distal joint of the finger. Similarly, a retaining means 30 may encircle the wrist area to keep the entire glove in place on the hand.

The glove may also contain a grip area 35 located on or near the palm of the glove. Fabricators often have a need to tension fabrics they are working on. This is frequently done by pushing down with the heel of the palm while pushing or pulling the fabric with the hand. The grip area 35 facilitates this operation by providing increased friction while protecting the part of the hand it overlies. The grip area 35 is preferably shaped and dimensioned to cover the heel of the palm and extend around the side of the hand adjacent the little finger. The grip area 35 may be made from any of the materials used for grip areas 15*a*–15*d* and may be applied in a similar manner.

Figure 2:
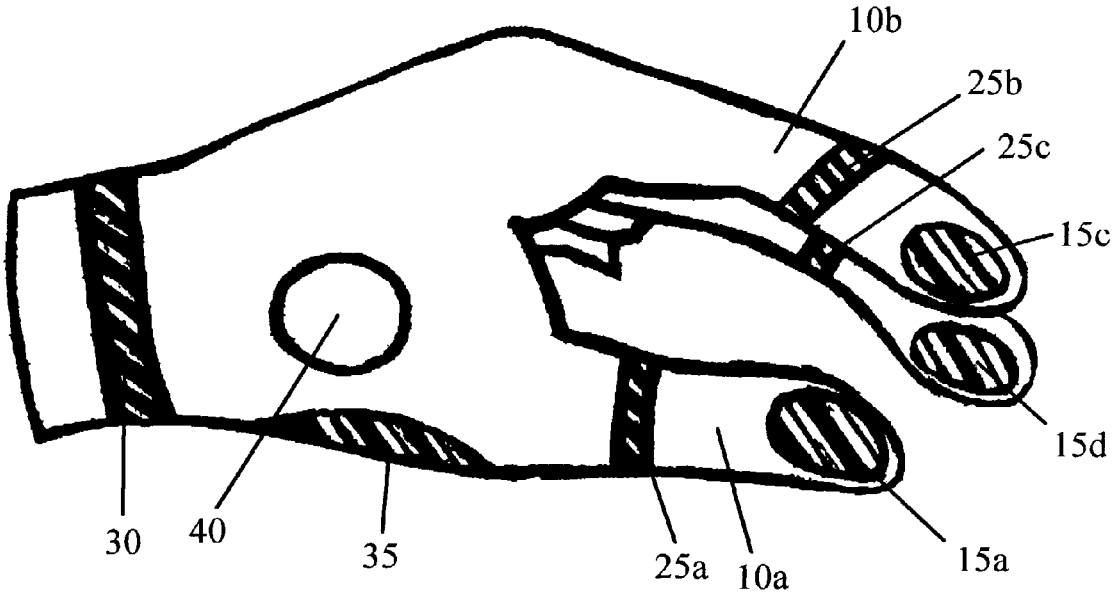
FIG. 2 is a side view of the glove for the left hand, palm side down.

A magnet 40 may be attached to the back of the glove to temporarily hold pins, needles and the like. Although the magnet 40 may be permanently affixed by adhesive or other means, it is preferred to have it removably attached to the glove. One simple method of removably attaching the magnet 40 is to provide a pocket in the back of the glove into which the magnet may be inserted. Ideally the pocket surrounds the periphery of the magnet 40 such that most of the magnet 40 is not covered by the pocket. The pocket can be made from the same material as the glove. Alternatively, hook and loop fasteners may be used to secure the magnet 40 to the back of the glove. The magnet 40 can be located anywhere on the back of the glove but most preferably is located so that it overlies an area between the metacarpal bones of the thumb and forefinger, as shown in FIG. 2. The magnet can be present on one glove of a pair, or both.

The glove can be manufactured using techniques known in the industry. The glove can be woven with openings 20*a* and 20*b*, or a standard glove can be used with the stalls for the ring finger and little finger cut off. Obviously, for a glove with two finger stalls, the glove can be woven with a third opening, or a third stall can be removed. In the case of a latex glove, known molding techniques may be utilized.

While there is shown and described a present preferred embodiment of the invention, it is to be distinctly understood that the invention is not limited thereto, but may be otherwise variously embodied and practiced.

I claim:

1. A device to facilitate the manipulation of sewing implements and fabrics comprising:

a seamless, knitted glove, having three full length fingers stalls including a thumb stall, index finger stall, a middle finger stall, and two finger openings for receipt of a ring finger and little finger to protrude therethrough, said thumb stall to fully contain a thumb, said index finger stall to fully contain an index finger, and said middle finger stall to fully contain a middle finger, said thumb stall, index finger stall and middle finger stall each having a distal end with an outer side, inner side, palm side, and back side, with the outer side of the index finger stall being a side closest to said thumb stall and said outer side of the middle finger stall being a side closest to said thumb stall, a first grip device overlying a portion of said thumb stall outer side and a portion of said thumb stall palm side, a second grip device overlying a portion of said thumb stall inner side and a portion of said thumb stall palm side wherein a portion of the thumb stall palm side between said grip devices remains uncovered by said grip devices such that a degree of tactile sensitivity is preserved at the uncovered portion, said index finger stall having one grip device overlying a portion of said outer side and a portion of said palm side, and said middle finger stall having one grip device overlying a portion of outer side and a portion of said palm side.

2. The device of claim 1 comprising said grip devices being non-rigid and substantially elliptical in shape.

3. The device of claim 1 comprising said grip devices made of thickened materials to form a shield made of natural or synthetic rubber and thermosetting or thermoplastic polymers with reinforcing material, or without reinforcing materials, said reinforcing materials are glass fibers, graphite fibers, or mineral particles, that grip without slippage.

* * * * *